US006508728B1

(12) United States Patent
Colletti

(10) Patent No.: US 6,508,728 B1
(45) Date of Patent: Jan. 21, 2003

(54) GOLF TEE AND GOLF BALL DISPLAY

(76) Inventor: Paul John Colletti, 393 Merrick Rd., Rockville Centre, NY (US) 11570

( * ) Notice: Subject to any disclaimer, the term of this patent is extended or adjusted under 35 U.S.C. 154(b) by 57 days.

(21) Appl. No.: 09/640,516

(22) Filed: Aug. 17, 2000

Related U.S. Application Data

(63) Continuation-in-part of application No. 09/222,286, filed on Dec. 28, 1998, now abandoned.

(51) Int. Cl.[7] ..... A63B 57/00
(52) U.S. Cl. ..... 473/388; 473/387
(58) Field of Search ..... 473/388

(56) References Cited

U.S. PATENT DOCUMENTS 1,103,091 A * 7/1914 Smith ..... 473/388
1,142,997 A * 6/1915 True ..... 473/388
1,604,390 A * 10/1926 Coker ..... 473/388
1,644,804 A * 10/1927 Whitcomb ..... 473/388
1,675,335 A * 7/1928 Drevitson ..... 473/388
1,783,211 A 12/1930 Baldwin
2,612,373 A * 9/1952 Pierce ..... 473/388
3,697,082 A * 10/1972 Di Laura et al. ..... 473/388

* cited by examiner

*Primary Examiner*—Paul T. Sewell
*Assistant Examiner*—Alvin A. Hunter
(74) *Attorney, Agent, or Firm*—Myron Amber, PC.

(57) ABSTRACT

A conical tee for a golf ball having a top nominal diameter opening in which the golf ball is seated and the bottom larger opening which is placed on the ground, the conical wall spanning the two openings being of a selected length so that the golf ball as foreground and a wall length of 1⅜ inch seen as background provide a bull's-eye target to the golfer which contributes to a better striking of the golf ball.

1 Claim, 1 Drawing Sheet

GOLF TEE AND GOLF BALL DISPLAY

This application is a continuation-in-part of my prior application Ser. No. 09/222,286 filed Dec. 28, 1998 now abandoned for "A Golf Tee and Golf Ball Display."

The present invention relates generally to improvements in a golf tee, the improvements more particularly not only properly supporting the golf ball in a clearance position above the ground in a well-known manner, but also significantly contributing to assisting the golfer, in a manner not heretofore known, in making, in golf parlance, firm contact with the golf ball, all as will be better understood as the description proceeds.

EXAMPLES OF THE PRIOR ART

It is already well known, as exemplified by prior patents subsequently described, that golf tees of wood, the construction material of choice, exhibit shortcomings of sometimes being difficult to push into the ground, particularly during late in the golf season in areas where frost conditions prevail, and when broken during use provide an unsightly appearance, to mention but a few of these shortcomings. Addressing this problem there are prior art efforts to replace wooden tees with conical shapes formed of flexible plastic die-cut blanks or other formed plastic which are readily manually manipulated in the flat so as to assume a three dimensional conical shape on the top which the golf ball is positioned preparatory to a tee-off shot. These known conical tees obviate the aforesaid shortcomings of wooden tees, but otherwise have nominal additional utility.

Broadly, it is an object of the present invention to provide a conical golf tee overcoming the foregoing and other shortcomings of wooden/rigid plastic golf tees, and also contributing to the proper execution of a golf swing.

More particularly, it is an object to use to advantage a golf tee sized with a radially extending wall visible in an address position beneath the golf ball to form a target display for the golfer which contributes to firmer stiking of the golf ball.

The description of the invention which follows, together with the accompanying drawings should not be construed as limiting the invention to the example shown and described, because those skilled in the art to which this invention appertains will be able to devise other forms thereof within the ambit of the appended claims.

FIG. 1. is a perspective view of a golfer in a position preparatory to stiking a golf ball supported on a golf tee according to the present invention;

It is acknowledged in connection with wooden or rigid plastic golf ball tees of the type that are pushed into the ground 10 of a golf course tee-off area 12, that efforts have been made to use as a replacement a pliable plastic die cut substrate that is manually manipulated so as to assume an open ended hollow conical shape in which the bottom and larger bottom end opening is placed on the ground 10 to provide balance, and in which the upper smaller end opening is used for the seating therein of a golf ball. Exemplifying these conical golf tee substitutes, in order of chronology, is the "Golf Tee" of U.S. Pat. No. 662,368 issued to Wetzel on Nov. 20, 1900, the "Golf Tee" of U.S. Pat. No. 1,103,091 issued to Smith on Jul. 14, 1914, the "Golf Tee" of U.S. Pat. No. 1,142,997 issued to True on Jun. 15, 1915, the "Golf Tee" of U.S. Pat. No. 1,152,649 issued to Luellan on Sept. 7, 1915, the "Golf Tee" of U.S. Pat. No. 1,215.316 issued to Benjamin on Feb. 6, 1917, the "Golf Tee" of U.S. Pat. No. 1,554,321 issued to Banigan on Sept. 22, 1925, and the "Combined Golf Tee and Score Card" issued to Whitcomb on Oct. 11, 1927.

In contrast with the specifically noted and all other known prior art conical golf tees, and constituting the within patentable advance is the recognition that the golfer is assisted in striking the golf ball not only by the clearance position that it occupies on the golf tee, but also by a display thereof which contributes to the golfer's focus on the golf ball, all as will be better understood as the description proceeds.

Figure 1:
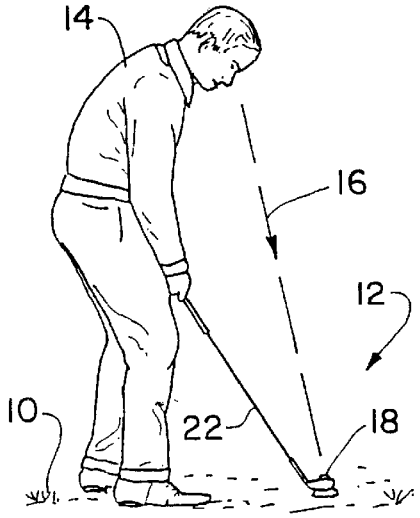

In FIG. 1, a golfer 14 is shown with a line of sight 16 in a so-called address position astride of a golf ball 18 focused on the within inventive conical golf tee 20 preparatory to executing a golf swing that will enable the golf club 22 to drive the golf ball 18 in flight.

Figure 2:
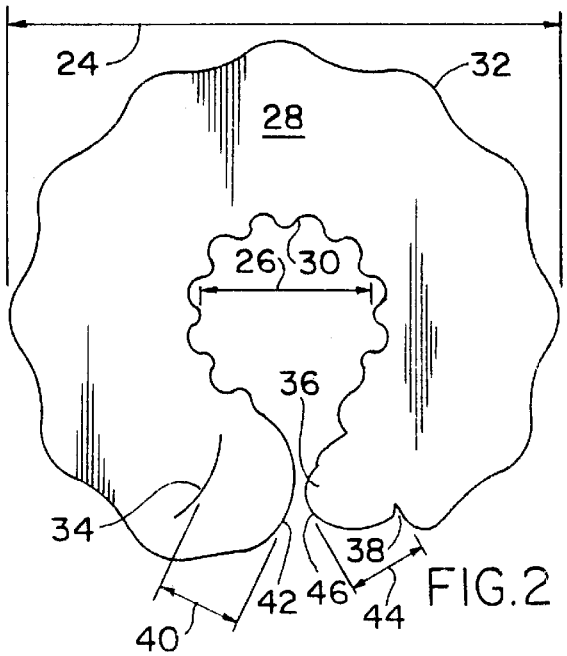
FIG. 2 is a plan view of the within inventive golf tee in the flat and prior to a construction into a three dimensional support for a golf ball.
Figure 3:
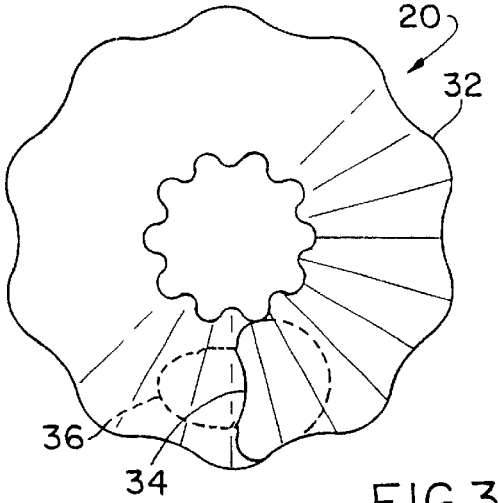
FIG. 3 is a plan view of a constructed golf tee into a three dimensional golf ball support.
Figure 5:
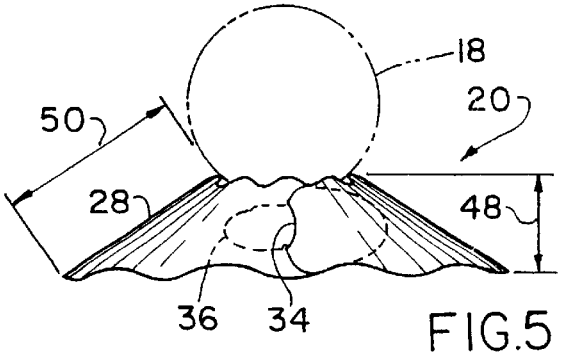
FIG. 5 is a front elevational view as seen along line 5—5 of FIG. 3 in which the golf ball has been illustrated in phantom perspective.

As best understood from FIG. 2, the within inventive golf tee 20 in a preferred embodiment is die-cut from a selected high density flexible plastic construction material, such as polyethylene, which in the flat, as illustrated, has an outside diameter 24 of approximately 4½ inches, a central opening 26 of approximately 1½ inches, such that a wall 28 of approximately 1⅜ inches extends between the edge 30 which bounds the central opening 26 and the edge 32 which delimits the outside diameter 24. A cooperating slot 34 cooperates, by receiving in projected relation therethrough, a tab 36 having a locking notch 38, to the end providing a conical shape in the golf tee 20 as best shown in FIG. 5, as a result of the interengagement, as shown in phantom perspective in FIGS. 3 and 5 of the slot 34 and notch 38.

Figure 4:
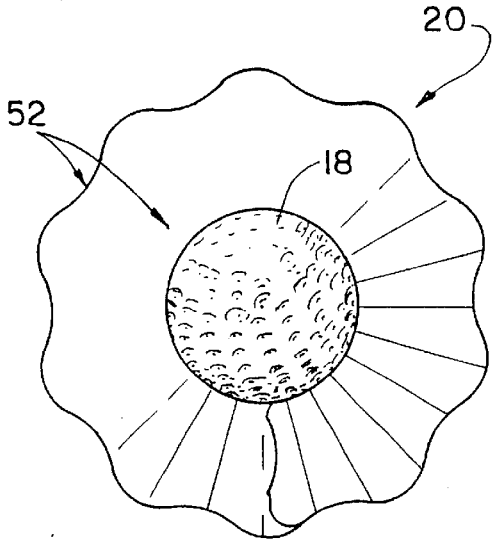
FIG. 4 is a plan view of the golf tee and golf ball as seen by the golfer in the golfing position of FIG. 1.

The location of the slot 34 the distance 40 inwardly from the edge 42 and the location of the notch 38 the distance 44 inwardly in the opposite direction from the edge 46 are selected to embody the constructed golf tee 20 with a height 48 of approximately one inch. Good results have been obtained using ¾ inch for distance 40 and ½ inch for distance 44, but it is well within the ability of one well versed in this art to use other dimensions to achieve in a three dimensional embodiment of the within inventive golf tee 20 a discemable size of at least one inch, denoted by the arrows 50, in the wall 28. Wall 28 will be understood to be of a color contrasting with the typical white color of the golf ball 18, possibly being yellow, so that what is seen by the golfer's line of sight 16 is a bull's eye-type target, generally designated 52 in FIG. 4, consisting of a yellow or like brightly colored wall 28 extending radically said at least one inch from beneath a centrally located golf ball 18 seated in the central opening 26. In practice, it has been found that the bull's eye-type target 52 provides a display that contributes to the golfer being able to make, in golf parlance, good contact with the golf ball.

It is specifically noted that by golf rules of play, the golf ball must conform to a specified diameter which currently is approximately 1½ inches. Thus, using this to advantage, the annexed claim calls for a tee with a 1⅜ inch wide wall since in practice this provides a tee display background with a desired extension beyond the 1½ inch diameter teed golf ball.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A display of a golf ball intended to be perceived by a golfer in a golf ball-striking address position in relation thereto, said display comprising in a flat configuration a generally circular shaped blank of high density polyethylene yellow colored construction material having an outer circumferential diameter of 4½ inches and an inner edge bounding a circular opening, a length portion of said generally circular blank removed so as to present opposing first and second edges delimiting therebetween a tee-constructing clearance, a slot circumferentially spaced from said first edge a distance of ¾ of an inch, a tab having a hooking configuration circumferentially spaced from said second edge a distance of ½ of an inch, an operative position of said hook configured tab into said slot so as to project said blank into a conical golf ball-supporting member having said inner edge of said blank bounding a 1½ inch diameter top opening, said outer circumferential edge of blank bounding a larger diameter bottom opening, and a 1⅜ inch wide wall extending in spanning relation between said top and bottom openings, a golf ball of a diameter in excess of 1½ inches seated in said top opening to serve as foreground for said display, and said 1⅜ inch wall extending outwardly beyond said seated golf ball serving as background for said display.

* * * * *